US010460710B2

(12) United States Patent
Hanks

(10) Patent No.: US 10,460,710 B2
(45) **Date of Patent: *Oct. 29, 2019**

(54) MUSICAL INSTRUMENTS INCLUDING KEYBOARD GUITARS

(71) Applicant: Michael S. Hanks, Odin, IL (US)

(72) Inventor: Michael S. Hanks, Odin, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/220,686

(22) Filed: Dec. 14, 2018

(65) Prior Publication Data

US 2019/0122647 A1 Apr. 25, 2019

Related U.S. Application Data

(63) Continuation of application No. 15/077,098, filed on Mar. 22, 2016, now Pat. No. 10,157,602.

(51) Int. Cl.

| | |
|---|---|
| ***G10H 1/34*** | (2006.01) |
| ***G10H 1/20*** | (2006.01) |
| ***G10H 1/055*** | (2006.01) |

(52) U.S. Cl.

CPC ..... *G10H 1/342* (2013.01); *G10H 1/0551* (2013.01); *G10H 1/20* (2013.01); *G10H 2210/225* (2013.01); *G10H 2220/096* (2013.01); *G10H 2220/301* (2013.01); *G10H 2230/365* (2013.01)

(58) Field of Classification Search

USPC ..... 84/615

See application file for complete search history.

(56) References Cited

U.S. PATENT DOCUMENTS

| | | | | |
|---|---|---|---|---|
| 2,192,077 | A | 2/1940 | Hanson, Jr. | |
| 3,023,659 | A | 3/1962 | Bode | |
| 3,541,912 | A | 11/1970 | Radke | |
| 3,555,166 | A | 1/1971 | Gasser | |
| D220,650 | S | 5/1971 | Poznanovich | |
| 3,610,800 | A | 10/1971 | Deutsch | |
| 3,674,907 | A | 7/1972 | Derry | |
| 3,971,282 | A | 7/1976 | Obayashi et al. | |
| D245,197 | S | 7/1977 | Noury, Jr. | |
| 4,078,464 | A | 3/1978 | Sugiyama | |
| 4,126,070 | A * | 11/1978 | Hill | G10H 1/185 84/718 |
| D254,496 | S | 3/1980 | Hill | |
| D256,366 | S | 8/1980 | Dworsky | |

(Continued)

*Primary Examiner* — David S Warren

(74) *Attorney, Agent, or Firm* — Harness, Dickey & Pierce, P.L.C.

(57) ABSTRACT

A musical instrument, for example, a keyboard guitar, includes a body, an elongated neck coupled to the body, neck keys disposed on the elongated neck, and an output for transmitting an electrical signal generated by the musical instrument. Activation of each neck key generates an electrical signal at the output representing a pitch associated with a musical note. The musical instrument may also include body keys disposed on the body, and a strum bar that generates an electrical signal at the output representing a pitch associated with a musical note based on which of the body keys are activated during activation of the strum bar. Further, the musical instrument may include a continuous graphic image spanning the front face of the body and the body keys, forming a continuous pattern that is unbroken across a transition between key surfaces of the body keys and the front face of the body.

14 Claims, 5 Drawing Sheets

(56) References Cited

U.S. PATENT DOCUMENTS 4,304,167 A * 12/1981 Tait ..... G10C 3/12 84/427
4,332,182 A 6/1982 Franz et al.
4,339,979 A 7/1982 Norman
RE31,019 E 8/1982 Evangelista
D278,066 S 3/1985 Garoogian
D278,154 S 3/1985 Baker
4,570,521 A 2/1986 Fox
D296,338 S 6/1988 Sgroi
4,794,838 A 1/1989 Corrigau, III
D310,090 S 8/1990 Stone et al.
4,974,486 A 12/1990 Wallace
5,113,742 A 5/1992 Matsumoto
5,121,668 A 6/1992 Segan et al.
D349,127 S 7/1994 Nelson
5,691,490 A * 11/1997 Williams ..... G10D 3/08 84/170
6,018,119 A * 1/2000 Mladek ..... G10H 1/342 84/722
6,111,179 A 8/2000 Miller
6,740,800 B1 * 5/2004 Cunningham ..... G10D 1/00 84/423 R
6,777,608 B1 8/2004 Redding
7,030,304 B1 * 4/2006 Harris ..... G10D 3/00 84/290
7,044,857 B1 5/2006 Klitsner et al.
D549,766 S 8/2007 Greenberg
7,396,987 B1 7/2008 Tentindo
7,635,809 B2 * 12/2009 Higgs ..... G10D 1/08 84/327
7,928,312 B2 4/2011 Sharma
8,426,719 B2 4/2013 Shim
8,847,051 B2 * 9/2014 Hanks ..... G10H 1/342 84/423 R
10,157,602 B2 * 12/2018 Hanks ..... G10H 1/342
2006/0090632 A1 * 5/2006 Ludwig ..... G10H 1/00 84/645
2007/0101853 A1 * 5/2007 Staleos ..... G10D 1/005 84/291
2007/0163420 A1 * 7/2007 Reiss ..... G10D 1/085 84/329
2008/0236360 A1 * 10/2008 Higgs ..... G10D 1/08 84/291
2009/0049980 A1 * 2/2009 Sharma ..... G10H 1/34 84/719
2009/0253509 A1 * 10/2009 Tripp ..... A63F 13/06 463/37
2013/0255474 A1 * 10/2013 Hanks ..... G10H 1/342 84/615
2014/0283670 A1 * 9/2014 Eventoff ..... G10H 3/00 84/723
2015/0206521 A1 * 7/2015 Sexton ..... G10H 3/146 84/609
2016/0163298 A1 * 6/2016 Butera ..... G10H 1/342 84/615
2017/0278500 A1 * 9/2017 Hanks ..... G10H 1/342

* cited by examiner

MUSICAL INSTRUMENTS INCLUDING KEYBOARD GUITARS

CROSS-REFERENCE TO RELATED APPLICATION

This application is a continuation of U.S. patent application Ser. No. 15/077,098, filed Mar. 22, 2016. The entire disclosure of the above application is incorporated herein by reference.

FIELD

The present disclosure generally relates to musical instruments, and more particularly to musical instruments including keyboard guitars.

BACKGROUND

This section provides background information related to the present disclosure which is not necessarily prior art.

Keyboard guitars provide a greater range of movement compared to a traditional keyboard. Rather than being confined to standing or sitting behind a stationary instrument, a keyboard guitar player is free to roam the stage. However, keyboard guitars still suffer from many drawbacks, which slow their adoption as a popular musical instrument.

Many keyboard guitars resemble keyboards more than guitars. Indeed, many keyboard guitars are little more than portable keyboards with short necks. This leads to a style of play that is more keyboard-like than guitar-like, both physically and musically. Further, while guitars have a pleasing aesthetic that is very popular amongst musicians, keyboard guitars often have a very unpleasing aesthetic that hurts their desirability as instruments regardless of a keyboard guitar's musical expressivity. Additionally, keyboard guitars have had limited functionality to enable the player to utilize popular musical techniques to enhance their musical expressivity when compared to the guitar, such as, for example, note bending, hammer-ons, pull-offs, tremolo, etc.

SUMMARY

This section provides a general summary of the disclosure, and is not a comprehensive disclosure of its full scope or all of its features.

Exemplary embodiments of the present disclosure generally relate to musical instruments including, for example, keyboard guitars. In one exemplary embodiment, a musical instrument generally includes a body, an elongated neck coupled to the body, a plurality of neck keys disposed on the elongated neck, and an output for transmitting an electrical signal generated by the musical instrument. Activation of each neck key generates an electrical signal at the output representing a pitch associated with a musical note.

In another exemplary embodiment, a musical instrument generally includes a body, an elongated neck coupled to the body, an output for transmitting an electrical signal generated by the musical instrument, and a plurality of body keys disposed on the body. Activation of each body key generates an electrical signal at the output representing a pitch associated with a musical note. The musical instrument also includes a strum bar disposed on the body, wherein activation of the strum bar generates an electrical signal at the output representing a pitch associated with a musical note, and the represented pitch is based on which of the neck keys are activated during activation of the strum bar.

In another exemplary embodiment, a musical instrument generally includes a body having a front face, an elongated neck coupled to the body, an output for transmitting an electrical signal generated by the musical instrument, and a plurality of body keys disposed on the front face of the body. Activation of each body key generates an electrical signal at the output representing a pitch associated with a musical note. The musical instrument further includes a continuous graphic image spanning the front face of the body and the plurality of body keys, thereby forming a continuous pattern that is unbroken across a transition between the key surfaces of the body keys and the front face of the body.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
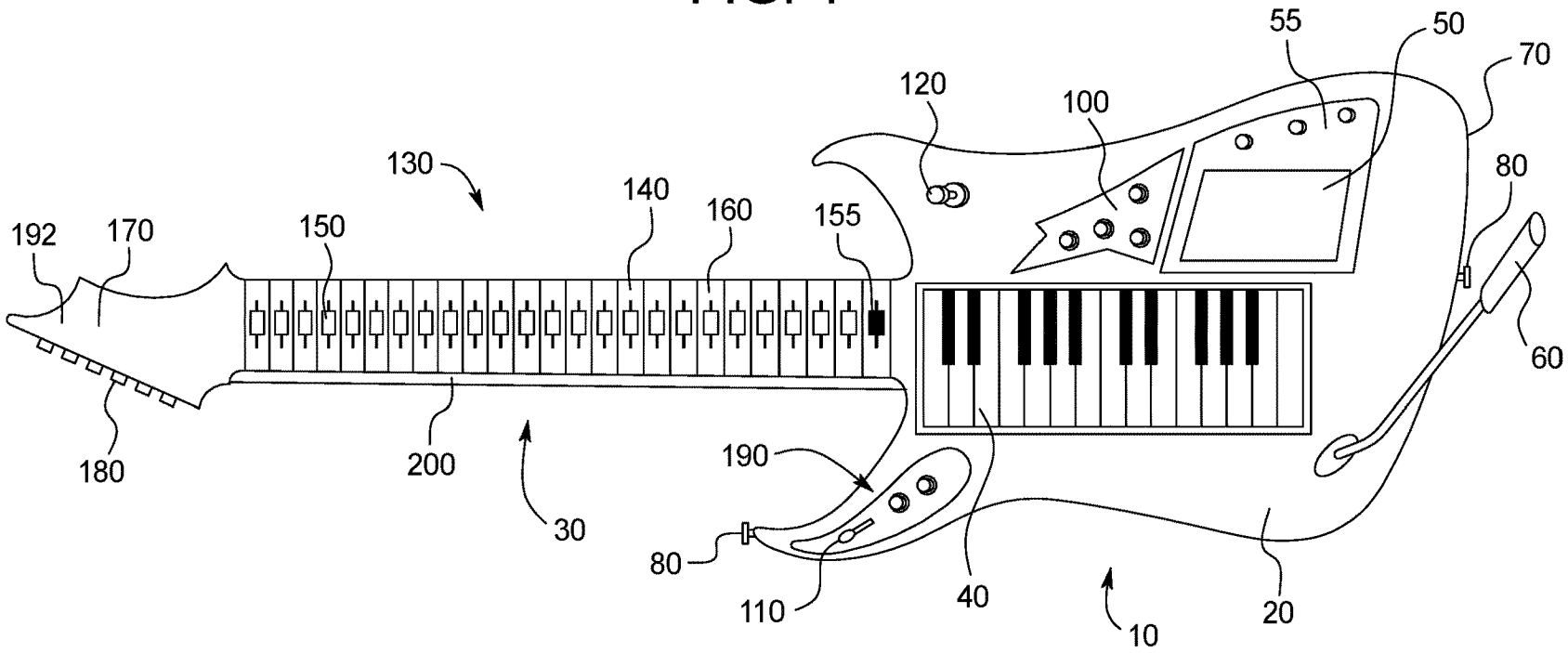
FIG. 1 is a front view of an exemplary embodiment of a musical instrument according to the present disclosure.

Exemplary embodiments will now be described more fully with reference to the accompanying drawings.

Described herein are exemplary embodiments of musical instruments including, for example, keyboard guitars (also known as keytars), etc., that enable users to experience a more guitar-like style of play that preserves the aesthetic of a guitar and provides the player the ability to use techniques that have the expressivity of a guitar.

In some exemplary embodiments, providing a keyboard guitar having a limited number of keys and an extended neck including neck keys and/or transpose buttons to control tuning allows a keyboard guitar to have a more guitar-like design and style of play. Further, by providing for transpose buttons capable of bending a note, a keyboard guitar may allow for techniques that have the expressivity of a guitar. Additional controls for greater tone control and flexibility provided herein may further enhance the functionality of the keyboard guitar.

In some exemplary embodiments, a keyboard guitar generally includes a body, substantially shaped like a guitar body, containing a keybed having a plurality of keys. The keyboard guitar also includes a fretboard, substantially shaped like a guitar fretboard, connected to the body and having a plurality of transpose buttons. The transpose buttons of the fretboard are configured to control the tuning of the keybed. By pressing the appropriate transpose button of the fretboard, a player may make an instantaneous change to the desired key. The transpose buttons of the fretboard may be manipulated to vary the pitch of a note being played, known as "bending the note."

In some exemplary embodiments, a neck of a keyboard guitar may include a touch sensitive surface, e.g. a touch controller, disposed along the top or the bottom of the neck. The touch controller may be configured to control the tuning of the keybed and to permit the player to vary the pitch of a note being played by dragging a finger along the touch sensitive surface. The keys of the keyboard may be maneuvered side-to-side while being pressed to create a tremolo effect.

The neck may include transpose buttons (e.g., at least twelve transpose buttons, less than twelve transpose buttons, etc.), each associated with a distinct key from the traditional Western music scale. The transpose buttons may be physically manipulated to alter the pitch represented by the electrical signal for each key. The elongated neck may further include a touch sensitive surface configured such that a user may alter the pitch represented by the electrical signal that is output by each of the keys by dragging a finger along the touch sensitive surface. The body and neck may be in the shape of an electric guitar. Each transpose button may be one half step up in tuning from a first adjacent transpose button and one half step down in tuning from a second adjacent transpose button.

In some exemplary embodiments, changing chords may be as simple as playing one chord on the keys and switching between transpose buttons with the fretting hand. The musical instrument can be played standing up using a strap around the shoulder and neck to hold the instrument, or sitting down with the keyboard guitar across the lap of the keyboard guitar player. Fewer keys may be required on the instrument body because optional transpose buttons and octave up and octave down buttons can cover more octaves thus allowing for a full range with fewer keys. In doing so, the keyboard guitar is able to take on a more appealing "guitar-like" look, as traditional keyboard guitars have the reputation for looking more like keyboards.

In some exemplary embodiments, musical instruments herein may provide improved musical expressiveness due to the function of the transpose buttons providing the capability of varying the tuning of the keyboard and varying the pitch of a note being played. Some keys may provide a tremolo effect provide the player with a greater range of expressiveness in playing. In addition, in some exemplary embodiments, the keybed may be replaceable, to allow the player more options and to suit player preferences, such as being flipped around to accommodate left handed players.

With reference now to the drawings, FIG. 1 illustrates an exemplary embodiment of a musical instrument illustrated, for example, as a keyboard guitar 10. FIG. 1 is merely one example of a shape and form of a musical instrument (and, also of the representative keyboard guitar 10). It should be understood that any suitable shapes and forms of a musical instrument may be used without departing from the scope of the present disclosure. For example, the physical shape of the illustrated keyboard guitar 10 may be made to match the stylistic preferences of players, etc.

As shown in FIG. 1, the keyboard guitar 10 includes a body 20 and a neck 30. The body 20 includes a keybed 40, a control screen 50, a whammy bar 60, and a cable jack 70 (broadly, an output). The body 20 also includes shoulder strap mounts 80, tone knobs 100, a tone switch 110, a pitch bender or tremolo joystick 120, and octave up and octave down buttons 190.

The neck 30 includes a fretboard 130 having a plurality of frets spaces 140. Each fret space 140 includes a transpose button 150 and a note indicator 160. The neck 30 also includes a neck pitch bender 155 to provide an alternative control to bend the pitch. In addition, the neck 30 includes a touch controller 200 (as an optional feature, for example) that runs along one side of the fretboard 130. The transpose buttons 150 are positioned in or near the center of the neck 30 running lengthways and are separated into frets spaces 140 by vertical lines mimicking the frets of a guitar. The neck 30 further includes a headstock 170. The headstock 170 includes a plurality of control knobs 180 and a second set of octave up and down buttons 192 (which may be similar in structure, for example, to buttons 190 (although such similarity is not required)).

In the illustrated keyboard guitar 10, the keybed 40 provides two octaves of keys. Alternatively, the keybed 40 may provide a greater or lesser number of keys. Further, the keys may be provided in different sizes and/or there may be multiple rows of keys provided in the keybed 40. In addition, the keybed 40 may be attached to the body 20 by screws and to the electronics via a wire harness, thus making the keybed 40 removable and allowing for the use of alternative keybeds, as desired. Alternative keybeds may include, for example, keybeds with varied configurations, and/or may include keybeds with varied tactile responsiveness, such as keybeds with different resistance (i.e., play) of the keys, etc. Further, alternative keybeds may come in a variety of designs and colors, permitting the design and color of the keybeds to match/coordinate/compliment the color and design of the body 20 of the keyboard guitar 10, or in designs desired by users, etc.

The keybed 40 may also be removable and reversible allowing the keybed 40 to be flipped around to accommodate left handed players. In some embodiments, the keybed 40 may be removed and replaced with a keybed having a different starting and ending point such that, for example, instead of starting and ending with C, the keybed could start and end with G or other notes. In some embodiments, the keybed 40 may also have stiffer or lighter keys, and in some embodiments, it may also have different colors and/or designs.

In addition, in one contemplated embodiment, the keybed 40 may have keys that make a tremolo effect when pressed and maneuvered (i.e., wiggled) side to side. Accordingly, in addition to the sensors used in a typical keybed 40 that react to varying key strikes, one or more additional sensors may be adapted to respond to the movement of the keys in a plane approximately ninety degrees from a traditional key strike.

As previously described, each fret space 140 of the fretboard 130 (at the neck 30 of the keyboard guitar 10) includes the associated transpose button 150, and the associated note indicator 160. The note indicator 160 may be (or may include) a plurality of LED lights that activate when the transpose button 150 is pressed or moved. Alternatively, the note indicator 160 may be (or may include) a screen display. In any case, the note indicator 160 may show the current tuning of the fret space 140. While described as LED lights or a display screen, it is understood that any suitable variations may be used in connection with the note indicator 160 within the scope of the present disclosure.

As shown in FIG. 1, the transpose buttons 150 of the fretboard 130 run the length of the fretboard 130. While shown with a specific form, the transpose buttons 150 can be formed in any shape and from any material appropriate for the functions described herein. In one embodiment, for example, the transpose buttons 150 may be formed with minimal topological relief (i.e., minimal peaks and valleys between the transpose buttons 150 and the fretboard 130), which improves the player's ability to slide across the notes (i.e., across the transpose buttons 150) similar to a guitar player's slide up or down a guitar's fretboard. In addition, it is contemplated that the transpose buttons 150 can be formed in any shape and from any material appropriate to allow heavy playing without fear of breaking the transpose buttons 150 and/or the transpose buttons 150 should be easily replaceable if broken. For example, the transpose buttons 150 may be made of smooth, strong plastic material that is smoothly tapered on all sides. Of course, numerous known material and shape substitutes may be used, as will be recognized by those skilled in the art.

In a standard setting mode of the keyboard guitar 10, the transpose buttons 150 may control the tuning of the keys of the keybed 40. For example, when the player presses, or otherwise activates, a transpose button 150, the tuning of each of the keys may change. In the illustrated embodiment, each transpose button 150 may be ½ step up in tuning from the one above it or ½ step down in tuning from the one below it. Thus, using a standard issue middle C keybed as the keybed 40, with the instrument and no transpose buttons 150 active, or with a designated "middle C" transpose button 150 active, the keys may be tuned to A 440 (i.e., standard tuning). Then, if the player were to activate the top fret button 150, or the fret button 150 just below a designated middle C transpose button 150, all of the keys in the keybed 40 may go up in tuning ½ step, causing the middle C key in the keybed 40 to sound like the note C# (i.e., C-4 sharp).

In some embodiments, the transpose buttons 150 may be adapted to also control the pitch of each note played on the keys. For example, each transpose button 150 may be adapted to slide along the width of the neck 30 to bend the note being played on the keys either up or down. In the standard setting mode, then, as the transpose button 150 is slid one direction across the neck, the note may "bend" up in pitch. As the transpose button 150 is slid in the opposite direction across the neck 30, the note may "bend" down in pitch. In one embodiment, each transpose button 150 may be adapted to bend a note up to a max of two half steps. The direction in which the transpose buttons 150 translate to bend a note up or down in pitch may be reversed and the magnitude of the bend may be adjusted to meet the preferences of players. Such parameters may be controlled, for example, through settings adjusted via the control screen 50.

In such embodiments, to accomplish the note bending functionality, each transpose button 150 may be mounted via one or more springs adapted to bias the transpose button 150 to its starting position (i.e., neutral position) upon release. The spring tension may be stiff so the transpose button 150 will not slide unintentionally. While a spring-loaded transpose button 150 is one example of a biasing mechanism that enables a transpose button 150 to perform as described, it should be recognized that there are numerous other mechanisms that may be used to accomplish the functions described herein.

With continued reference to FIG. 1, the neck 30 of the keyboard guitar 10 includes (e.g., optionally, etc.) the touch controller 200 that runs along the length of the neck 30. The touch controller 200 may be touch sensitive, e.g., a capacitive touch sensor, etc. The touch controller 200 may be used during play to transpose notes, depending on the direction the player moves his or her finger(s) that is touching the touch controller 200. For example, the player may slide his or her finger(s) up or down the length of the touch controller 200, shifting the pitch of the note currently being played, similar to the way a guitar player would slide his or her finger up or down a guitar string. As with other elements of the keyboard guitar 10, a player may alter the behavior of the touch controller 200 by changing settings though the control screen 50. For example, additional and/or alternate effects may be triggered or modified by the touch controller 200, depending on desired settings applied by the player. While shown with a single touch controller 200, alternatively, the keyboard guitar 10 may include two touch controllers, one on each side of the neck 30, to permit ease of access or increased play options.

In some embodiments, the entire fretboard 130 of the keyboard guitar 10 may be (or may operate as) a touch controller (in a similar manner to the touch controller 200). In such embodiments, the fret spaces 140, transpose buttons 150, and note indicators 160 may be virtually presented and controlled on the touch controller. In addition, in such embodiments the touch controller may include a capacitive touch screen that displays virtual fret spaces, transpose buttons, and note indicators. The virtual fret spaces, transpose buttons, and note indicators may operate as described above for the fret spaces 140, transpose buttons 150, and note indicators 160, including the vibrato and sliding functionalities. Further in such embodiments, the touch controller may also be pressure sensitive and permit the playing of additional effects. Again, the settings of the touch controller in these embodiments may be adjusted via the control screen 50 as desired.

As described, various settings of the keyboard guitar 10 may be adjusted via the control screen 50, and/or via one or more other controls associated with the keyboard guitar 10. Modifying the various settings may adjust the behavior of the keyboard guitar 10, etc. For example, the tuning of the keyboard guitar 10 at rest (i.e., a default tuning) may be set and adjusted by a setting. Another setting may determine, when a transpose button 150 is activated and then released, whether the instrument holds the tuning until another transpose button 150 is activated, or whether the tuning reverts back to the default tuning when released. The settings for the transpose buttons 150 may also be changed, as a group or individually, to provide for alternate tunings. For example, a setting may be adjusted such that when in the default tuning, the transpose button 150 that would normally represent middle C is set to a middle D, such that when this transpose button 150 is activated, the keys on the keybed 40 are transposed up in tuning one full step. To better aid the player's understanding of the present configuration of the keyboard guitar 10, the note indicators 160 may be adapted to show the current tuning of the transpose button 150.

With further reference to FIG. 1, the knobs 100 on the body 20 of the keyboard guitar 10 may be positioned approximately consistent with the placement of similar knobs on a guitar and may be used to control various audio settings, such as tone, volume, reverb, and chorus. In addition, changing settings through the control screen 50 may modify the function of the knobs 100.

The pitch bender or tremolo joystick 120 may be a joystick (as illustrated) or a wheel, and may be used for bending notes or tremolo, depending on the settings chosen through the control screen 50, for example. As shown, the pitch bender or tremolo joystick 120 may be positioned on the lower part of the body 20 so that the left fretting hand can easily reach it from underneath the keyboard guitar 10. Similarly, the tone switch 110 may be positioned consistent with the placement of a tone switch on a guitar and may be used to change various audio settings, such as weighting the overall tonal response to the bass or treble side. In a preferred embodiment, the tone switch 110 may have five different positions like that of an electric guitar pickup switch, mimicking the selection of various pickup configurations. And, again, the function of the tone switch 110 may be modified by changing settings through the control screen 50, for example.

The whammy bar 60 is a long metal bar attached to the keyboard guitar body 20. The whammy bar 60 may be positioned as shown, adjacent to the keybed 40, or at any alternative position that permits the player easy access. The whammy bar 60 may be configured to be unscrewed and removed or moved to alternative positions. As with the other tonal controls, the function of the whammy bar 60 may also be modified by changing settings through the control screen 50. For example, the sensitivity of the whammy bar 60 may be adjusted through the control screen 50. When a player presses, moves, etc. the whammy bar, the pitch of the electrical signals generated by activation of keys of the musical instrument may be altered.

The illustrated keyboard guitar 10 includes two sets of octave up and down buttons: the first octave up and down buttons 190; and the second octave up and down buttons 192. The octave up and down buttons 190 and 192 may be configured to control the octave to which the transpose buttons 150 of the fretboard 130 correspond. For example, by pressing the octave up button (of either sets of buttons 190 and 192), the transpose button 150 corresponding to middle C by default, may be adjusted to correspond to the C one octave above middle C. The octave up and down buttons 190 and 192 are shown to be placed near the fretboard 130 on both the side of the body 20 and the headstock 170 to provide easy access while playing either high or low on the fretboard 130. The function of the octave up and down buttons 190 and 192 may be modified by changing settings through the control screen 50.

The control knobs 180 of the keyboard guitar 10 are shown to be included on the head 170. The control knobs 180 may be configured to permit adjustment of various sound parameters. The function of the plurality of control knobs 180 may also be modified by changing settings through the control screen 50.

As described above, numerous aspects of the keyboard guitar 10 may be adjusted through the control screen 50. As shown in FIG. 1, the control screen 50 may be configured to display information about the current settings and state of the keyboard guitar 10. The control screen 50 may be an LCD screen, plasma screen, or other display capable of being incorporated into the keyboard guitar 10, and furthers include associated control buttons 55. In some embodiments, the control screen 50 may be a capacitive touch screen to permit the user to input settings directly through the control screen 50, rather than through the associated control buttons 55 (such that the buttons 55 may not be included).

The cable jack 70 (broadly, and input/output) of the keyboard guitar may be configured to receive a standard instrument cable to connect the keyboard guitar 10 to an amp/rack module. In an alternative embodiment, the cable jack 70 may allow for connection with a non-standard instrument cable in order to transmit the instrument signal and/or to provide power to the keyboard guitar 10. Alternatively, multiple cable jacks may be provided to separate a cable carrying power to the keyboard guitar 10 from a cable carrying the instrument signal. In this configuration, the multiple cable jacks may be positioned close together so that multiple cables can stay together either in a single jacket or tied together with hook and loop fastener straps. In another embodiment, the keyboard guitar 10 may be configured to run on batteries, eliminating the need for a power cable. In a further embodiment, the keyboard guitar 10 may be configured to transmit the instrument signal wirelessly, such that an output of the keyboard guitar 10 is a wireless transmitter.

Figure 2:
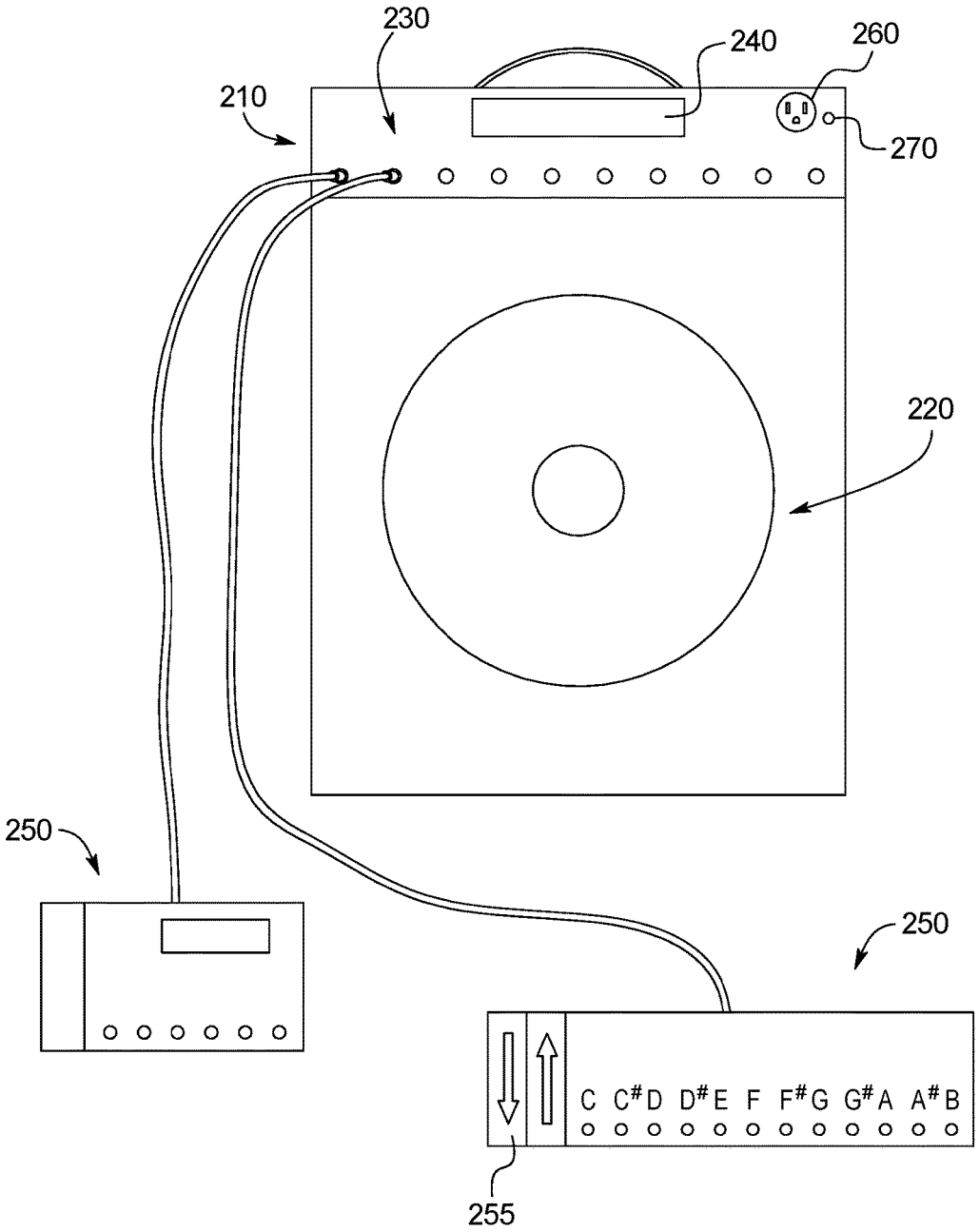
FIG. 2 is an a front view of an example rack module, speaker cabinet and foot-operated controller for use with the musical instrument of FIG. 1.

FIG. 2 illustrates an exemplary embodiment of a custom rack module 210. The keyboard guitar 10 may be configured to interoperate with the custom rack module 210, as desired. For example, the rack module 210 may receive the instrument signal from the keyboard guitar 10 for further processing, and which may be amplified to drive a speaker cabinet 220. In addition, the rack module 210 may be configured to be used with a standard guitar amp and sized to fit in a standard guitar rack. The rack module 210 may have knobs, buttons, and/or other controls 230 for adjusting sound, changing settings, and for controlling a backlit display 240. The display 240 may show settings, display the current state of the rack module 210 and/or keyboard guitar 10, program sounds or effects, and may be optionally controlled by one or more foot-operated controllers 250.

The rack module 210 also includes a power receptacle 260 to receive a power cable to power the keyboard guitar 10, for example, and an instrument jack 270 to receive an instrument cable carrying the instrument signal. As illustrated, the power receptacle 260 and the instrument jack 270 may be positioned adjacent to each other to permit the power cable and the instrument cable to be tied together, assembled in a single jacket, etc. (although such positioning is not required in all embodiments).

In operation, the keyboard guitar 10 may be adapted to interoperate with the various foot-operated controllers 250. One of the foot-operated controllers 250 includes a transpose controller that may allow for the player to transpose the keys or change octaves by pressing the foot switches 255, instead of using the transpose buttons 150, to permit the player to use both hands while playing the keys on the keybed 40. The transpose controller may connect to the rack module 210 by cable. Similarly, the keyboard guitar 10 may be configured to interoperate with other additional foot-operated controllers, including various foot switches or effect pedals. The foot switches or effect pedals may allow for the player to program sounds and/or effects controlled by the rack module 210. The foot switches or effect pedals can connect to the rack module 210 by cable.

Figure 3:
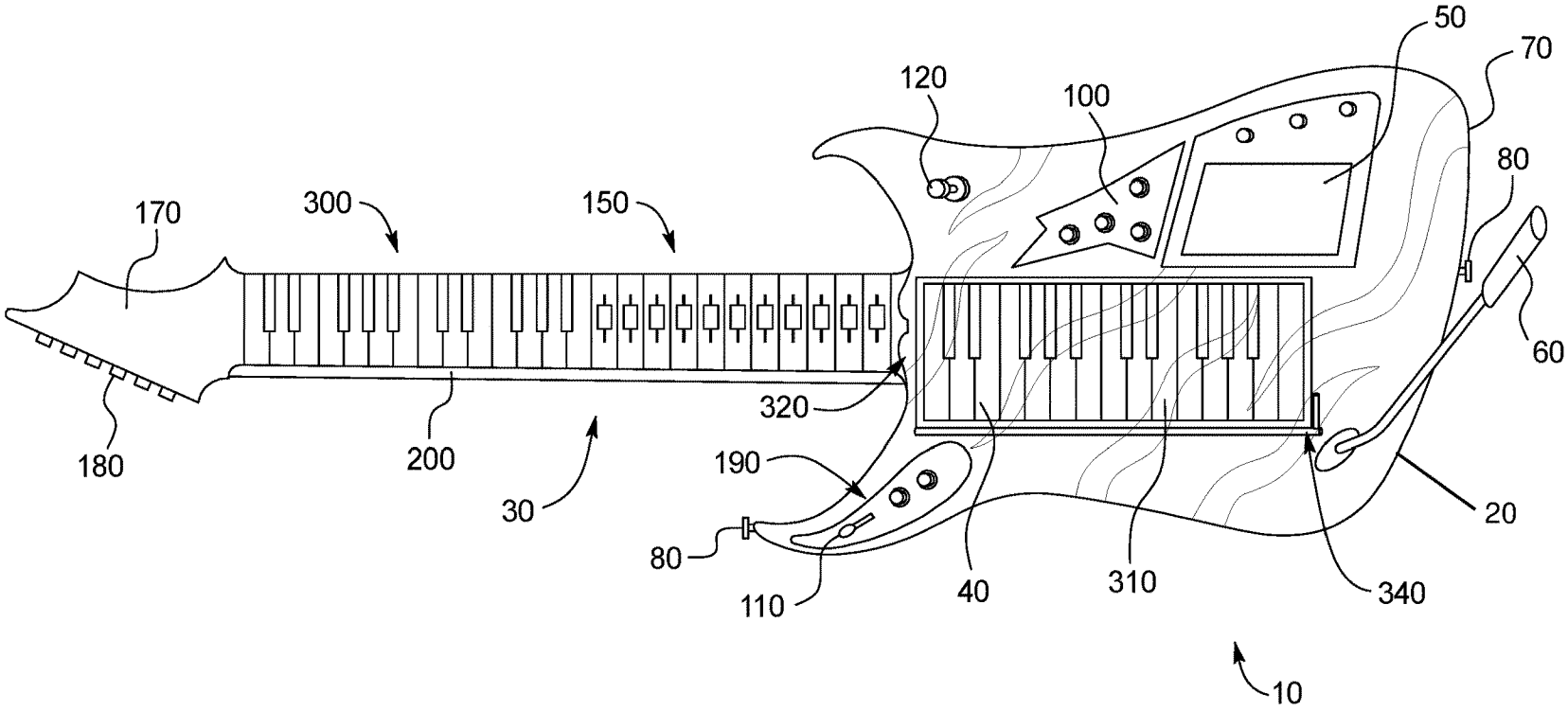
FIG. 3 is a front view of another exemplary embodiment of a musical instrument according to the present disclosure, and including a continuous graphical image spanning a body and keys of the musical instrument.

FIG. 3 illustrates another exemplary embodiment of a keyboard guitar 10 including one or more aspects of the present disclosure. The keyboard guitar 10 is similar to the keyboard guitar 10 illustrated in FIG. 1 and previously described. As such, various features of the keyboard guitar 10 illustrated in FIG. 3 that are similar to the keyboard guitar 10 illustrated in FIG. 1 are not repeated.

The keyboard guitar 10 of this embodiment generally includes a body 20 with a keybed 40 and a neck 30. The keybed 40 includes body keys 310. The neck 30 includes a plurality of transpose buttons 150 and a plurality of fret keys 300 (broadly, neck keys).

The fret keys 300 on the neck 30 of the keyboard guitar 10 may play notes in a manner that is the same as or similar to the body keys 310. In addition, the fret keys 300 may be flat in configuration (or may come in any shape), and/or may come in any color, and may be made of a touch sensitive material in some embodiments. In addition, in some embodiments, the fret keys 300 may be arranged similar to the pattern of a piano keyboard, with the fret keys 300 being similar to the shape of piano keys and facing the same way as the body keys 310 of the keybed 40 on the body 20 to help the user identify the notes. In one example, the playable fret keys 300 on the neck 30 and the body keys 310 may be tuned in the chromatic scale as one long keyboard, such that if one were to lay the keyboard guitar 10 down flat, with the neck 30 facing to his/her left, the playable fret keys 300 on the neck 30 would be the lower notes and the body keys 310 to the right would be the higher notes, just like a regular keyboard.

In other embodiments, the fret keys 300 and the body keys 310 of the keyboard guitar 10 may be individually tuned so that the keys 300 and 310 are not a continuous playable keyboard (e.g., not each one semitone apart). By permitting a configurable independent tuning of the fret keys 300 and the body keys 310, the user may enjoy different styles of play. For example, if users want to play the higher notes on the fret keys 300 with the left hand, the keys 300 and 310 may be tuned to a variety of musical scales other than chromatic scale, etc. As such, it should be appreciated that the fret keys 300 and the body keys 310 may be adapted to play notes in almost any configuration. In some example embodiments, the group of fret keys 300 and the group of body keys 310 may be capable of being tuned to different notes or octaves, either together or separately, so that they may be tuned together to form the chromatic scale, may be tuned to play unison notes, may be tuned to the scales in different octaves, may have overlapping notes, etc.

The fret keys 300 may also be used to control accompaniment music, by playing a single note or chord. The fret keys 300 on the neck 30 may also be configurable to permit the user to assign them to be used as transpose buttons 150, as may be accomplished using controls 230, for example, of the rack module 210 (when the keyboard guitar 10 is coupled thereto). Likewise, some of the fret keys 300 may be assigned to be played as notes while some are assigned to be used as transpose buttons 150 or to control other effects such as pitch bending, etc. Other buttons may also be added to the neck 30 and/or the body 20 for controls and/or for navigating or as assigned effects. What's more, the fret keys 300 and the body keys 310 may also be manipulated while playing to bend the notes or control other effects of the keyboard guitar 10. For example, the fret keys 300 and the body keys 310 may be sensitive to pressure or vibration such that the user may bend the notes or control other effects. Further, the keyboard guitar 10 may have its own onboard sounds or have no sounds and be used as a midi controller.

With continued reference to FIG. 3, the neck 30 of the illustrated keyboard guitar 10 may be adjustable up and down to help the user find a comfortable playing position. In order to allow for adjusting the neck 30, the neck 30 is connected to the body 20 by a hinge 320. The hinge 320 may be coupled between the neck 30 and body 20 to allow the neck 30 to be rotated relative to the body 20. It should be appreciated that any suitable hinge may be used (e.g., butt hinges, butterfly hinges, flush hinges, barrel hinges, piano hinges, etc.)

In addition, the keybed 40 on the body 20 of the keyboard guitar 10 may be adjustable or made to swivel around a pivot 340 connecting the keybed 40 to the body 20, so that a user may adjust it (e.g., angle it, etc.) to find a comfortable position. As an example, the keybed 40 may be adjusted to be straight on the body 20, angled on the body 20, etc. The pivot 340 may be located in the center of the keybed 40 or at one of the corners of the keybed 40, for example.

Further in this embodiment, the body keys 310, the transpose buttons 150, and/or the fret keys 300 are configured to generally match the color of the body 20, and include a drawing, pattern, etc. across them to help camouflage the keyboard guitar 10 from looking like a traditional keytar and making it look much more like a guitar. For example, the keyboard guitar 10 may have a continuous design patterned across it, such as tiger stripes, flames, etc. (as illustrated in FIG. 3), wherein the body 20 and the body keys 310 form a continuous graphic image pattern that is unbroken across a transition between the body 20 and the body keys 310. In some embodiments, the body keys 310 and/or the fret keys 300 may be any color, and/or the natural keys and accidental keys may be decorated with a matching color, etc.

It should be appreciated that having a continuous design patterned across the body 20 and body keys 310 of the keyboard guitar 10, as shown in FIG. 3, may give the keyboard guitar 10 an appearance that is more similar to a typical guitar design, and deemphasize the appearance of the body keys 310 on the body 20, for example. The continuous design may also help to blend the body keys 310 into the body 20 to create a more pleasing aesthetic appearance to users of the keyboard guitar 10. In some embodiments, the continuous design may be a solid color such that the color of the body keys 310 blends into the color of the body 20. It should be appreciated that any desired pattern, color, etc. may be included.

Figure 4:
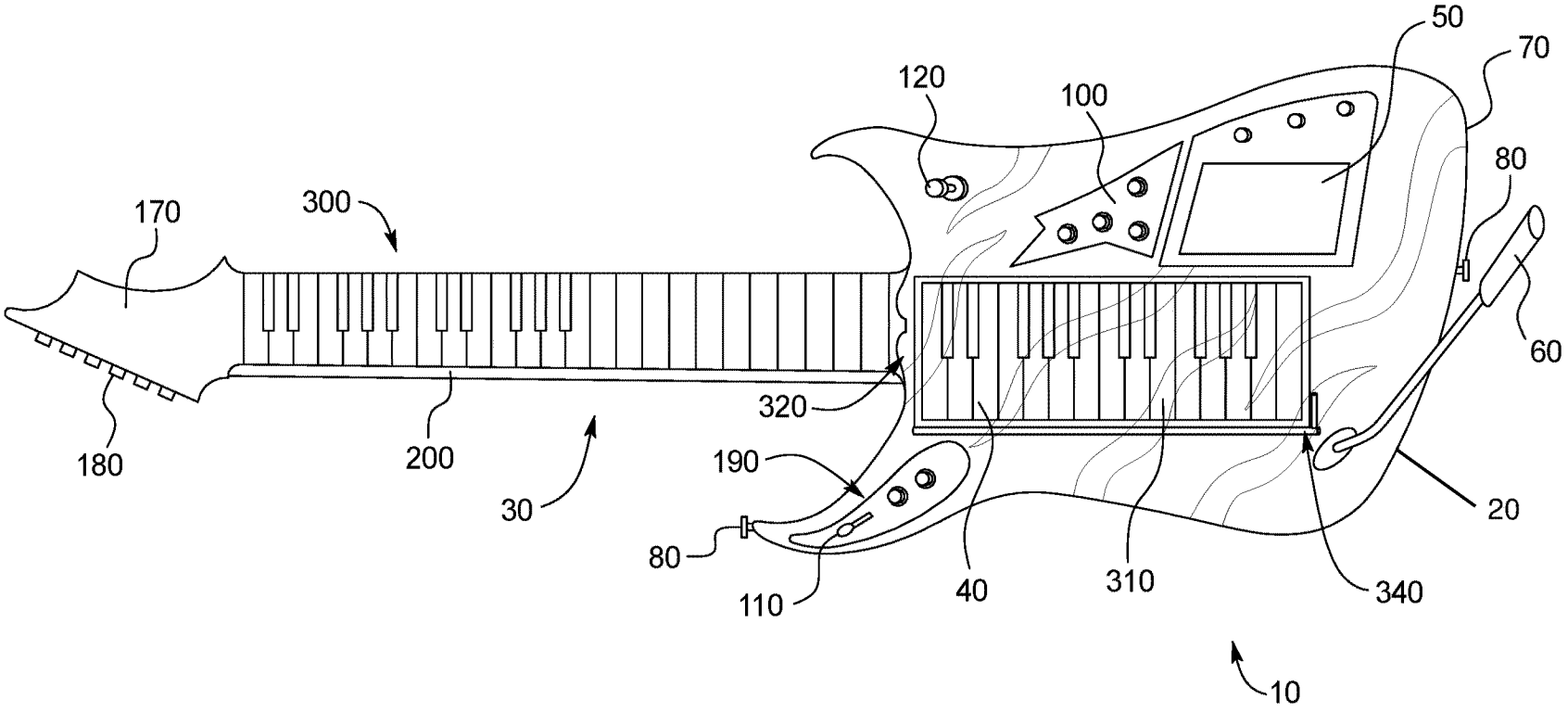
FIG. 4 is a front view of another exemplary embodiment of a musical instrument according to the present disclosure, and including a plurality of neck keys on a neck of the musical instrument without any transpose buttons.

Although the keyboard guitar 10 illustrated in FIG. 3 illustrates a neck 30 having both transpose buttons 150 and neck keys 300, it should be appreciated that other embodiments of the keyboard guitar 10 may include a neck 30 having neck keys 300 without any transpose buttons 150. For example, FIG. 4 illustrates an example keyboard guitar 10, substantially similar to the keyboard guitar 10 of FIG. 3 (such that various features of the keyboard guitar 10 illustrated in FIG. 4 that are similar to the keyboard guitar 10 illustrated in FIG. 3 are not repeated), with a neck 30 having neck keys 300, but no transpose buttons. The neck keys 300 may extend along only a portion of the neck 30, along an entire length of the neck 30, etc. In addition, in some embodiments, the keyboard guitar 10 may include the neck keys 300 without having any body keys, such that the only keys of the musical instrument are on the neck 30. As should be apparent, exemplary embodiments may include any combination of neck keys, body keys, and/or transpose buttons, without departing from the scope of the present disclosure.

Figure 5:
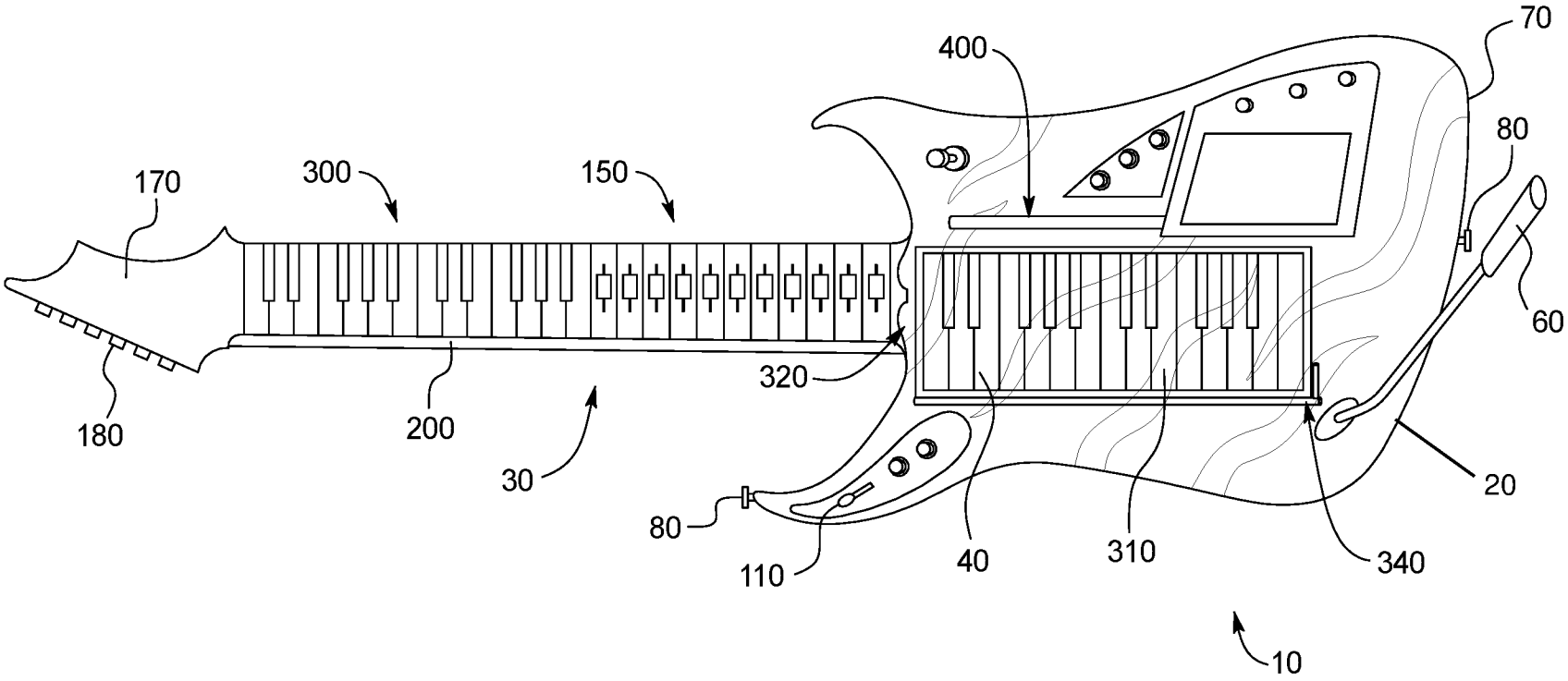
FIG. 5 is a front view of another exemplary embodiment of a musical instrument according to the present disclosure, and including a strum bar.

FIG. 5 illustrates another exemplary embodiment of a keyboard guitar 10 including one or more aspects of the present disclosure. The keyboard guitar 10 is again similar to the keyboard guitar 10 illustrated in FIG. 1 and previously described. As such, various features of the keyboard guitar 10 illustrated in FIG. 5 that are similar to the keyboard guitar 10 illustrated in FIG. 1 are not repeated.

In this embodiment, the keyboard guitar 10 includes a strum bar 400 on the body 20 of the keyboard guitar 10. In some embodiments, the strum bar 400 may be located close to body keys 310 so the user may easily go back and forth between playing the body keys 310 and the strum bar 400. The strum bar 400 may be affixed on the body 20 horizontally and may play a note or notes when pressed downward or upward, among other potential operations.

In some embodiments, the strum bar 400 may emulate the manner of note playing experienced with a guitar, for example, on the down strum, on the up strum, etc. Here, fret keys 300 and/or the body keys 310 of the keyboard guitar 10 may only make a sound when depressed while the strum bar 400 is played, similar to a guitar player fretting a string on the neck and then picking or strumming the strings with the other hand on the body. Accordingly, the note or notes that the strum bar 400 plays may be determined by which key(s) are being pressed at the time of the strum. This would allow the user to use the fretting hand to play notes or chords with the fret keys 300 and then strum like a guitar player to make the sound. If no fret keys 300 are being pressed, the strum bar 400 may play the same notes as a standard tuned guitar, however alternate tunings would also be possible. Other settings may allow the strum bar 400 and fret keys 300 to both play separate notes at the same time.

In addition, the strum bar 400 may send a signal to make a sound, even if no fret keys 300 or body keys 310 are pressed simultaneously. This functionality is similar to how a guitar will still play notes when the strings are strummed even though the strings on the neck aren't being pressed down on the neck. Similarly, the strum bar 400 may be assigned to play a preset note or notes or any sound, or to control sound effects. Alternatively, the strum bar 400 may be assigned as the up or down scroll control for display 240, for example, of the rack module 210 (when the keyboard guitar 10 is coupled thereto), when not being used for the above mentioned operations.

Further, the strum bar 400 may be adapted to detect multiple levels of activation of the strum bar 400, including but not limited to a pressure of strum bar activation, a speed of strum bar activation, etc. For example, the strum bar 400 may detect a pressure of activation by the player to generate larger volume signals when the strum bar 400 is pressed harder, and smaller volume signals when the strum bar 400 is pressed more lightly. Similarly, the strum bar 400 may detect a speed of activation to generate musical note(s) at a faster frequency, tempo, etc. when a player presses the strum bar 400 at a higher speed. Accordingly, the strum bar 400 may be adapted to detect a style of play by the user depending on how the user is activating the strum bar 400. This may allow the strum bar 400 to emulate the manner of playing a guitar, including the speed at which notes are played and the volume at which notes are played.

In some embodiments, keyboard guitars may include neck keys and strum bars to allow users to play notes by holding down selected neck keys and activating the strum bars, which will then generate electrical signals representing musical note(s) based on the neck keys that are pressed while the strum bars are activated. Such embodiments may or may not include body keys.

The example keyboard guitars described herein may provide one or more (or none) of example advantages listed below. For example, the fret keys on the necks of the keyboard guitars may be used to control the accompaniment music, permitting users to make up chord changes while playing. This may reduce the need for assignable buttons to control preprogrammed chord changes, may increase the number of available cords, may increase the number of available notes within a chord, etc.

Example keyboard guitars described herein may also provide the ability to play notes on the necks while at the same time bending the notes without using the other hand or foot, much like a guitar player.

Further, example keyboard guitars having adjustable necks, with multiple positions, may help users find comfortable playing positions. And, adjustable keybeds on bodies of the keyboard guitars, with multiple positions, may thereby allow the keybeds to be angled relative to front faces of the bodies, may help users find comfortable playing positions, etc.

Example keyboard guitars described herein may have the appearance and/or shape of an electric guitar, with keys on the body that are camouflaged to hide the look of the keys, which may be unpopular, unattractive, etc. to some users. The keyboard guitar may have a body and an elongated neck that is equal to or longer than the body, and a keybed with the same coloring for the natural keys and the accidental keys, or more than one color for the natural keys and more than one color for the accidental keys. This unique combination of a guitar shape and camouflaged keys can provide a more electric guitar like look.

In some embodiments, by having a keyboard guitar with playable fret keys on the neck that are capable of playing notes in addition to the body keys, the user will be able to play more notes and have increased range. The user may be able to play notes with both hands while still holding the neck, giving a more guitar like style of play. The instrument may provide a more comfortable means of playing with two hands.

In some embodiments, by providing playable notes on the neck the user may play the notes on the neck with both hands similar to a style of play used by guitarists called finger tapping. Fret keys on the neck may be configured to control accompaniment music, which may allow the user to change the key of the accompanied music using a variety of chords. Also, by having control of the accompanied music with the fret keys, the user may be able to change chords like a guitar player would change chords, using the fretting hand.

Exemplary embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that exemplary embodiments may be embodied in many different forms, and that neither should be construed to limit the scope of the disclosure. In some exemplary embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values are not exclusive of other values that may be useful in one or more of the examples disclosed herein.

The terminology used herein is for the purpose of describing particular exemplary embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally," "about," and "substantially," may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the exemplary embodiments.

Spatially relative terms, such as "inner," "outer," "beneath," "below," "lower," "above," "upper," "left,", "right" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With that said, the foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A musical instrument, comprising:

a body;

an elongated neck coupled to the body, wherein the body and the elongated neck define an electric guitar shape, wherein the elongated neck has a length that is greater than or equal to a length of the body, and wherein the body includes a middle portion that is narrower than opposite end portions of the body;

a plurality of neck keys disposed on the elongated neck;

a plurality of body keys disposed on the body; and an output for transmitting an electrical signal generated by the musical instrument;

wherein activation of each neck key generates an electrical signal at the output representing a pitch associated with a musical note corresponding to the activated neck key, wherein activation of each body key generates an electrical signal at the output representing a pitch associated with a musical note corresponding to the activated body key, and wherein the plurality of body keys and the plurality of neck keys are tuned in a continuous chromatic scale that spans the plurality of body keys and the plurality of neck keys.

2. The musical instrument of claim 1, further comprising a hinge disposed between the body and the neck and coupling the neck to the body, thereby allowing the neck to move relative to the body.

3. The musical instrument of claim 1, wherein the plurality of body keys are disposed in a keybed on the body.

4. The musical instrument of claim 3, further comprising a pivot coupled to the keybed and the body to allow movement of the keybed relative to the front face of the body.

5. The musical instrument of claim 4, wherein the pivot is arranged to position the keybed at multiple different angles relative to the body.

6. The musical instrument of claim 3, wherein the keybed is releaseably engaged to the body and moveable between one of a first orientation and a second orientation different from the first orientation.

7. The musical instrument of claim 6, wherein the first orientation is a one hundred eighty degree rotation of the second orientation.

8. The musical instrument of claim 1, wherein the elongated neck further includes a touch sensitive surface configured to alter the pitch represented by the electrical signal generated by the body keys and/or the neck keys.

9. The musical instrument of claim 8, wherein the touch sensitive surface is configured to alter the pitch represented by the electrical signal generated by the body keys and/or the neck keys in response to a user dragging a finger along the touch sensitive surface.

10. The musical instrument of claim 1, further comprising a whammy bar coupled to the body, the whammy bar adapted to adjust the electrical signal generated by the body keys and/or neck keys when the whammy bar is moved.

11. The musical instrument of claim 1, wherein the neck includes a plurality of transpose buttons located along a length of the neck.

12. The musical instrument of claim 11, wherein the transpose buttons are configured to control tuning of the body keys and the neck keys such that activation of each of the transpose buttons alters the pitch represented by the electrical signal that is generated by each of the body keys and the neck keys.

13. The musical instrument of claim 1, wherein each of the plurality of body keys comprise physical keys having a piano key shape.

14. The musical instrument of claim 13, wherein each of the plurality of neck keys comprise physical keys having a piano key shape.

* * * * *